US009239558B2

(12) United States Patent
Moorlag et al.

(10) Patent No.: US 9,239,558 B2
(45) Date of Patent: Jan. 19, 2016

(54) SELF-RELEASING NANOPARTICLE FILLERS IN FUSING MEMBERS

(75) Inventors: Carolyn Moorlag, Mississauga (CA); Nan-Xing Hu, Oakville (CA); Guiqin Song, Milton (CA)

(73) Assignee: XEROX CORPORATION, Norwalk, CT (US)

( * ) Notice: Subject to any disclaimer, the term of this patent is extended or adjusted under 35 U.S.C. 154(b) by 721 days.

(21) Appl. No.: 12/401,820

(22) Filed: Mar. 11, 2009

(65) Prior Publication Data

US 2010/0233494 A1 Sep. 16, 2010

(51) Int. Cl.
*G03G 15/20* (2006.01)

(52) U.S. Cl.
CPC .... *G03G 15/2057* (2013.01); *G03G 2215/2032* (2013.01); *Y10T 428/259* (2015.01); *Y10T 428/31663* (2015.04)

(58) Field of Classification Search
CPC ... G03G 15/2053–15/2057; G03G 2215/2032; Y10T 428/24355; Y10T 428/2443
USPC ..... 399/328, 333; 428/327, 328, 421, 422; 384/13; 430/124.32–124.33
See application file for complete search history.

(56) References Cited

U.S. PATENT DOCUMENTS

| | | | | |
|---|---|---|---|---|
| 4,711,818 | A * | 12/1987 | Henry | 428/421 |
| 4,777,087 | A | 10/1988 | Heeks et al. | |
| 5,182,173 | A * | 1/1993 | Swei | 428/391 |
| 5,501,881 | A | 3/1996 | Fuller et al. | |
| 5,512,409 | A | 4/1996 | Henry et al. | |
| 5,729,813 | A | 3/1998 | Eddy et al. | |
| 5,945,223 | A | 8/1999 | Kuntz et al. | |
| 6,224,978 | B1 | 5/2001 | Chen et al. | |
| 6,569,932 | B2 | 5/2003 | Hsiao et al. | |
| 6,766,738 | B2 * | 7/2004 | Blumm et al. | 101/232 |
| 6,797,444 | B2 * | 9/2004 | Itami | 430/58.2 |
| 7,050,743 | B2 * | 5/2006 | Blair et al. | 399/170 |
| 7,127,205 | B2 | 10/2006 | Gervasi et al. | |
| 7,193,015 | B1 | 3/2007 | Mabry et al. | |
| 7,249,559 | B2 * | 7/2007 | McNeil | 101/483 |
| 7,252,885 | B2 * | 8/2007 | Pickering et al. | 428/421 |
| 7,294,377 | B2 * | 11/2007 | Gervasi et al. | 428/36.8 |

(Continued)

FOREIGN PATENT DOCUMENTS

| | | | |
|---|---|---|---|
| CA | 2260470 C | * | 10/2007 |
| EP | 1267223 | | 12/2002 |

(Continued)

OTHER PUBLICATIONS

Hongxia Wang et al., "One-step coating of fluoro-containing silica nanoparticles for universal generation of surface superhydrophobicity", Chem. Commun., 2008, pp. 877-879.

(Continued)

*Primary Examiner* — Scott R Walshon
(74) *Attorney, Agent, or Firm* — MH2 Technology Law Group LLP

(57) ABSTRACT

In accordance with the invention, there are fuser subsystems including a fuser member and methods of making a member of the fuser subsystems. The fuser member can include a substrate and a top-coat layer disposed over the substrate, the top-coat layer including a plurality of fluorinated nanoparticles substantially uniformly dispersed throughout a bulk of a fluoropolymer to provide a continual self-releasing surface to the top-coat layer.

16 Claims, 6 Drawing Sheets

(56) References Cited

U.S. PATENT DOCUMENTS

| | | | | |
|---|---|---|---|---|
| 7,991,340 | B2 * | 8/2011 | Qi et al. | 399/333 |
| 8,354,160 | B2 * | 1/2013 | Jing et al. | 428/143 |
| 2002/0098243 | A1 * | 7/2002 | Edelmann et al. | 424/497 |
| 2005/0090015 | A1 | 4/2005 | Hartmann-Thompson | |
| 2005/0173780 | A1 | 8/2005 | Sethumadhavan et al. | |
| 2006/0222815 | A1 * | 10/2006 | Oles et al. | 428/145 |
| 2006/0263536 | A1 | 11/2006 | Blair et al. | |
| 2006/0263538 | A1 * | 11/2006 | Kaplan et al. | 427/421.1 |
| 2007/0148438 | A1 | 6/2007 | Pickering et al. | |
| 2007/0298216 | A1 * | 12/2007 | Jing et al. | 428/141 |
| 2008/0213491 | A1 | 9/2008 | Moorlag et al. | |
| 2008/0277724 | A1 | 11/2008 | Qi et al. | |
| 2010/0035070 | A1 | 2/2010 | Moorlag | |
| 2010/0086787 | A1 * | 4/2010 | Qi et al. | 428/421 |
| 2010/0183348 | A1 * | 7/2010 | Law et al. | 399/333 |
| 2010/0183864 | A1 * | 7/2010 | Qi et al. | 428/319.1 |

FOREIGN PATENT DOCUMENTS

| | | |
|---|---|---|
| JP | H10-204224 | 8/1998 |
| JP | 2003-080165 | 3/2003 |
| WO | 9923536 | 5/1999 |

OTHER PUBLICATIONS

European Search Report; European Application No. 10155474.9-2204; European Patent Office, Jun. 30, 2010, 4 Pages.

Final Office Action dated Jan. 30, 2014, U.S. Appl. No. 12/185,886, filed Aug. 5, 2008, pp. 1-17.

Final Office Action dated Aug. 23, 2012, U.S. Appl. No. 12/185,886, filed Aug. 5, 2008, pp. 1-18.

Non-Final Office Action dated Jun. 15, 2011, U.S. Appl. No. 12/185,886, filed Aug. 5, 2008, pp. 1-16.

Iacono et al., "Synthesis, Characterization, and Surface Morphology of Pendant Polyhedral Oligomeric Silsesquioxane Perfluorocyclobutyl Aryl Ether Copolymers", Macromolecules, vol. 40, 2007, pp. 9517-9522.

Non-Final Office Action dated Oct. 2, 2014, U.S. Appl. No. 12/185,886, filed Aug. 5, 2008, pp. 1-37.

* cited by examiner

SELF-RELEASING NANOPARTICLE FILLERS IN FUSING MEMBERS

DESCRIPTION OF THE INVENTION

1. Field of the Invention

The present invention relates to image forming apparatus and fuser members and, more particularly, to methods of making fuser members.

2. Background of the Invention

In an electrophotographic printing process, a toner image on a media is fixed by feeding the media through a nip formed by a fuser member and a pressure member in a fuser subsystem and heating the fusing nip, such that the toner image on the media contacts a surface of the fuser member. The heating causes the toner to become tacky and adhere to the media. However, the toner particles of the toner image can stick to the fuser member besides adhering to the media, resulting in an image offset. If the offset image on the fuser is not cleaned, it may print onto the medium in the next revolution and result in unwanted image defects on the print. To overcome toner staining, i.e. the adhesion of the heat softened toner particles onto the surface of the fuser member, conventional fusing technologies use fuser members coated with a non-adhesive coating including flouroelastomer. However, fluoroelastomer fuser rolls currently require the use of a PDMS-based fusing oil for release, which results in end-use application issues.

Accordingly, there is a need to overcome these and other problems of prior art to provide fuser members with new top-coat materials for oil-less, long-lifetime, high performance fusing applications and methods of making them.

SUMMARY OF THE INVENTION

In accordance with various embodiments, there is a fuser subsystem including a fuser member. The fuser member can include a substrate and a top-coat layer disposed over the substrate, the top-coat layer including a plurality of fluorinated nanoparticles substantially uniformly dispersed throughout a bulk of a fluoropolymer to provide a continual self-releasing surface to the top-coat layer.

According to yet another embodiment, there is a method of making a member of a fuser subsystem. The method can include providing a fuser member, the fuser member including a substrate and forming fluorinated nanoparticles by co-hydrolysis of a mixture including a metal alkoxide and a fluoroalkylsilane. The method can also include dispersing the fluorinated nanoparticles into a fluoropolymer to form a coating composition, such that the fluorinated nanoparticles are substantially uniformly dispersed in the fluoropolymer and applying the coating composition over the substrate to form a coated substrate. The method can further include curing the coated substrate to form a top-coat layer over the substrate and polishing the top-coat layer such that the top-coat layer comprises a continual self-releasing surface.

Additional advantages of the embodiments will be set forth in part in the description which follows, and in part will be obvious from the description, or may be learned by practice of the invention. The advantages will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

DESCRIPTION OF THE EMBODIMENTS

Reference will now be made in detail to the present embodiments, examples of which are illustrated in the accompanying drawings. Wherever possible, the same reference numbers will be used throughout the drawings to refer to the same or like parts.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

Figure 1:
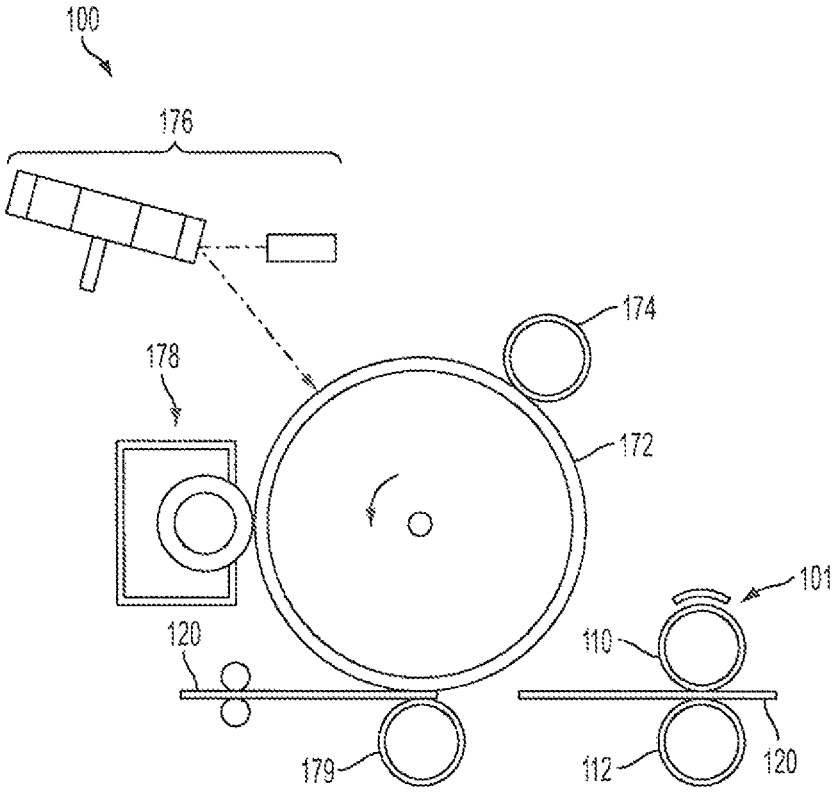
FIG. 1 schematically illustrates an exemplary printing apparatus, according to various embodiments of the present teachings.
Figure 5:
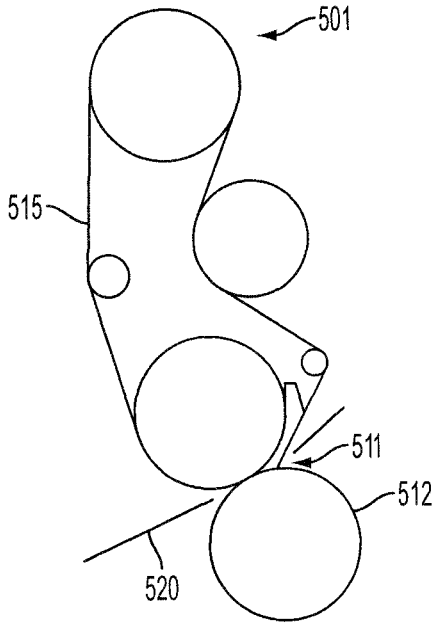
FIG. 5 schematically illustrates an exemplary fuser subsystem of a printing apparatus, according to various embodiments of the present teachings.

FIG. 1 schematically illustrates an exemplary printing apparatus 100. The exemplary printing apparatus 100 can include an electrophotographic photoreceptor 172 and a charging station 174 for uniformly charging the electrophotographic photoreceptor 172. The electrophotographic photoreceptor 172 can be a drum photoreceptor as shown in FIG. 1 or a belt photoreceptor (not shown). The exemplary printing apparatus 100 can also include an imaging station 176 where an original document (not shown) can be exposed to a light source (also not shown) for forming a latent image on the electrophotographic photoreceptor 172. The exemplary printing apparatus 100 can further include a development subsystem 178 for converting the latent image to a visible image on the electrophotographic photoreceptor 172 and a transfer subsystem 179 for transferring the visible image onto a media 120. The printing apparatus 100 can also include a fuser subsystem 101 for fixing the visible image onto the media 120. The fuser subsystem 101 can include one or more of a fuser member 110, a pressure member 112, oiling subsystems (not shown), and a cleaning web (not shown), wherein the fuser member and/or the pressure member 112 can have a top-coat layer including a plurality of fluorinated nanoparticles substantially uniformly dispersed in a fluoropolymer. In some embodiments, the fuser member 110 can be a fuser roll 110, as shown in FIG. 1. In other embodiments, the fuser member 110 can be a fuser belt, 515, as shown in FIG. 5. In various embodiments, the pressure member 112 can be a pressure roll 112, as shown in FIG. 1 or a pressure belt (not shown).

Figure 2:
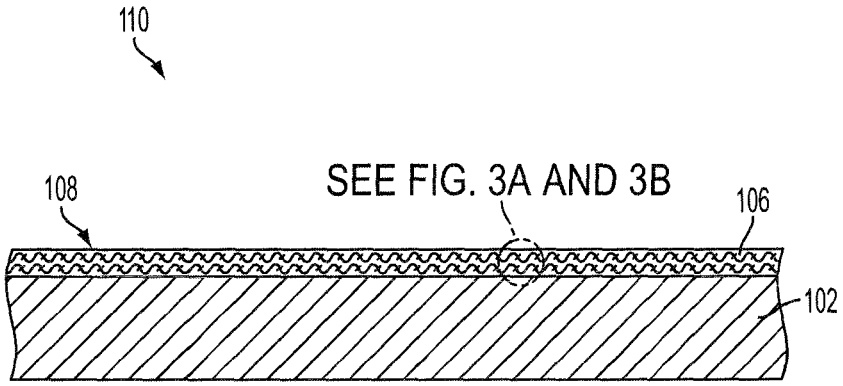
FIG. 2 schematically illustrates a cross section of an exemplary fuser member shown in FIG. 1, according to various embodiments of the present teachings.
Figure 3A:
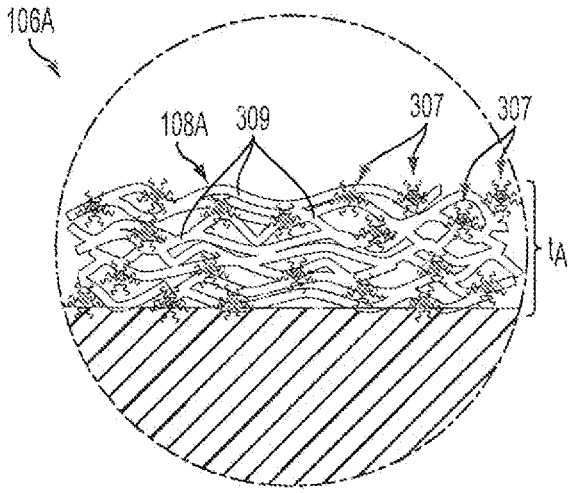
FIGS. 3A and 3B schematically illustrates an exemplary top-coat layer before and after normal use wear, according to various embodiments of the present teachings.
Figure 3B:
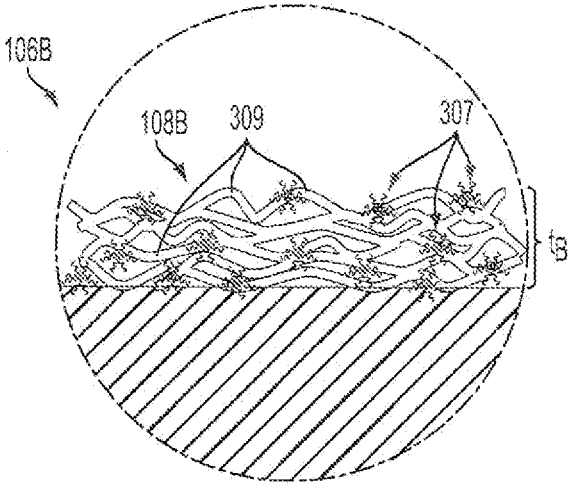

Referring back to the fuser member 110, FIG. 2 schematically illustrates a cross section of an exemplary fuser member 110. In various embodiments, the exemplary fuser member 110 can include a top-coat layer 106 disposed over a substrate 102. The top-coat layer 106 can include a plurality of fluorinated nanoparticles 307 substantially uniformly dispersed throughout a bulk of a fluoropolymer 309 to provide a continual self-releasing surface 108 to the top-coat layer 106 as shown in FIGS. 3A and 3B. In various embodiments, the plurality of fluorinated nanoparticles 307 can be substantially non-agglomerated. As used herein, the term "substantially non-agglomerated fluorinated nanoparticles" refers to both single fluorinated nanoparticles and small clusters of fluorinated nanoparticles. As used herein, the term "self-releasing surface" refers to a surface that release media with a minimal amount of fusing oil, or without the use of fusing oil. Also used herein, the term "continual self-releasing surface" refers to a surface that maintains its self releasing surface regardless of a decrease in thickness due to wear. While not intending to be bound by any specific theory, it is believed that the continual self-releasing surface 108 of the top-coat layer 106 is a result of the substantially uniform dispersion of the fluorinated nanoparticles 307 with inherently low surface energy in the fluoropolymer 309 throughout the bulk. As shown in FIG. 3A, the top-coat layer 106A having a thickness $t_A$ includes self-releasing surface 108A, due to the presence of fluorinated nanoparticles 307 substantially near the surface. FIG. 3B shows the top-coat layer 106B after wear having a thickness $t_B$, wherein $t_B$ is less than $t_A$. However, despite the wear, the top-coat layer 106B still includes a self-releasing surface 108B, due to the presence of fluorinated nanoparticles 307 substantially near the surface. Hence, the top-coat layer 106 maintains the continual self-releasing surface 108 during fusing even after thickness change due to wear caused by normal use.

In various embodiments, plurality of fluorinated nanoparticles 307 can include fluorinated oxide nanoparticles formed by co-hydrolysis of a mixture including a metal alkoxide and a fluoroalkylsilane as starting materials. Exemplary metal alkoxides can include, but are not limited to tetramethyl orthosilicate, tetraethyl orthosilicate, tetrabutyl orthosilicate, tetrapropyl orthosilicate, titanium butoxide, titanium propoxide, titanium ethoxide, titanium methoxide, zirconium ethoxide, zirconium propoxide, and mixtures thereof. Any suitable fluoroalkyl silane can be used such as, for example, fluoroalkyltrichlorosilane, fluoroalkyltrimethoxysilane, and fluoroalkyltriethoxysilane, wherein the fluoroalkyl group can include from about 6 to about 30 carbon atoms and at least five fluorine atoms. Exemplary fluoroalkylsilane can include, but are not limited to nonafluorohexyltrimethoxysilane, nonafluorohexyltriethoxysilane, tridecafluorooctyltrimethoxysilane, tridecafluorooctyltriethoxysilane, heptadecafluorodecyltrimethoxysilane, heptadecafluorodecyltriethoxysilane, and mixtures thereof. Exemplary preparation of fluorinated silica nanoparticles by hydrolysis and condensation of tetraethylorthosilicate and tridecafluoro(octyl)triethoxysilane is shown below in scheme 1:

Scheme 1

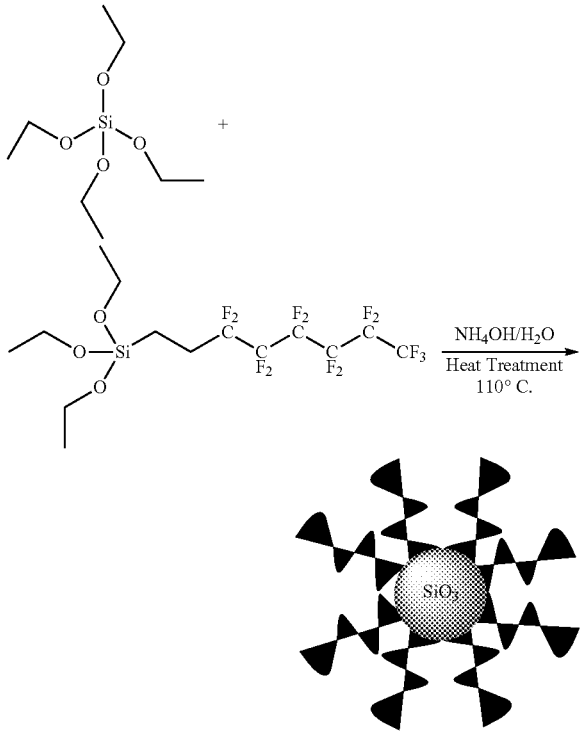

In some embodiments, the mixture including a metal alkoxide and a fluoroalkylsilane as starting materials can also include at least one of a silane compound, an aminosilane compound, or a phenol-containing silane compound. Exemplary aminosilane compound can include, but are not limited to 4-Aminobutyltriethoxysilane, N-(2-aminoethyl)-3-aminopropyltriethoxysilane, N-(2-aminoethyl)-3-aminopropylmethyidiethoxysilane, N-(2-aminoethyl)-3-aminopropyltrimethoxysilane, 3-aminopropyltrimethoxysilane, 3-aminopropyltriethoxysilane, 3-aminopropylmethyldimethoxysilane, 3-aminopropylmethyldiethoxysilane, and mixtures thereof. Exemplary phenol-containing silane compound can include, but are not limited to:

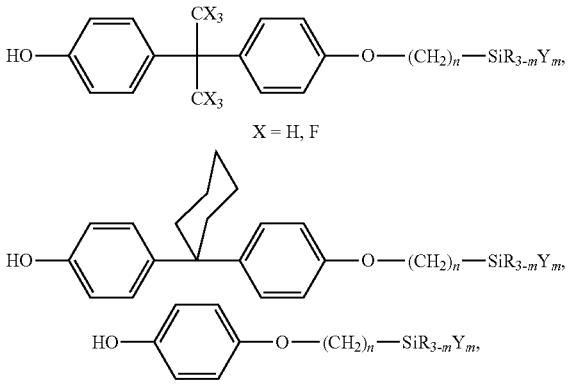

-continued

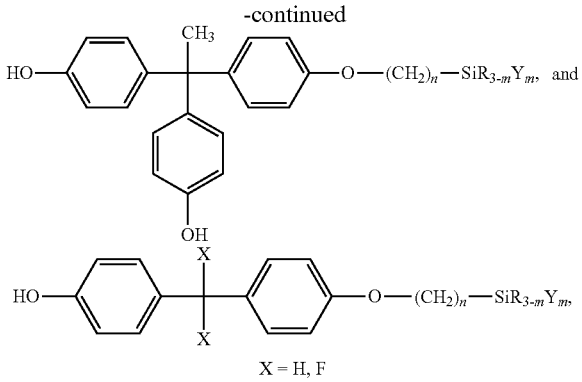

wherein R is a hydrocarbyl group including 1 to about 15 carbon atoms; Y can be any suitable group such as, for example, hydroxyl, alkoxy, halide, carboxylate; n is an integer from 1 to 12; and m is an integer from 1 to 3.

One-step coating of fluoro-containing silica nanoparticles is disclosed in Wang et. al., *Chem. Commun.,* 2008, pp 877-879, the disclosure of which is incorporated by reference herein in its entirety.

In some cases, the fluorinated nanoparticles 307 can have an average diameter in the range of about 10 nm to about 500 nm, in other cases in the range of about 10 nm to about 200 nm, and in some other cases in the range of about 10 nm to about 100 nm. In some embodiments, the fluorinated nanoparticles 307 can be present in an amount ranging from about 0.5 to about 20 percent by weight of the top-coat layer 106 composition and in other embodiments, from about 5 to about 15 percent by weight of the top-coat layer 106 composition.

In various embodiments, the fluoropolymer 309 can include more than about 60% of fluorine content by weight of the fluoropolymer 309. In some embodiments, the fluoropolymer 309 can include a polymer having one or more monomer repeat units selected from the group consisting of vinylidene fluoride, hexafluoropropylene, tetrafluoroethylene, perfluoro(methyl vinyl ether), perfluoro(propyl vinyl ether), perfluoro(ethyl vinyl ether), and the mixtures thereof. However, any other suitable monomeric repeat unit can be used. Exemplary fluoropolymer 309 can include, but is not limited to, polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP).

In certain embodiments, the fluorinated nanoparticle 307 can include a moiety chemically bound with the fluoropolymer. In other embodiments, the fluoropolymer 309 can be crosslinked using a cross-linking agent, such as, for example, a bis-phenol, a diamine, and an aminosilane.

In some cases, the top-coat layer 106 can have a thickness from about 50 nm to about 300 μm and in other cases, the top-coat layer 106 can have a thickness from about 3 μm to about 80 μm.

Figure 4:
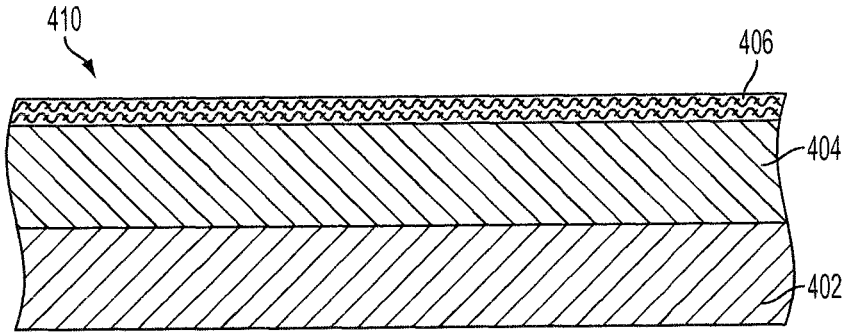
FIG. 4 schematically illustrates a cross section of another exemplary fuser member, according to various embodiments of the present teachings.

FIG. 4 schematically illustrates a cross section of another exemplary fuser member 410 The exemplary fuser member 410 can include a compliant layer 404 disposed over a substrate 402 and a top-coat layer 406 including a plurality of fluorinated nanoparticles dispersed in a fluoropolymer disposed over the compliant layer 404, such that the top-coat layer 106, 406 can have a continual self-releasing surface 108. In various embodiments, the compliant layer 404 can include at least one of a silicone, a fluorosilicone, or a fluorelastomer. Exemplary materials for the compliant layer can include, but are not limited to, silicone rubbers such as room temperature vulcanization (RTV) silicone rubbers; high temperature vulcanization (HTV) silicone rubbers; and low temperature vulcanization (LTV) silicone rubbers. Exemplary commercially available silicone rubbers include, but is not limited to, SILASTIC® 735 black RTV and SILASTIC® 732 RTV (Dow Coming Corp., Midland, Mich.); and 106 RTV Silicone Rubber and 90 RTV Silicone Rubber (General Electric, Albany, N.Y.). Other suitable silicone materials include, but are not limited to, SYLGARD® 182 (Dow Corning Corp., Midland, Mich.); siloxanes (preferably polydimethylsiloxanes); fluorosilicones such as Silicone Rubber 552 (Sampson Coatings, Richmond, Va.); dimethylsilicones; liquid silicone rubbers such as, vinyl crosslinked heat curable rubbers or silanol room temperature crosslinked materials; and the like. In some cases, the compliant layer 404 can have a thickness from about 10 μm to about 10 mm and in other cases from about 3 mm to about 8 mm.

Referring back to the fuser member 110, 410 as shown in FIGS. 1, 2, 4, the substrate 102, 402 can be a high temperature plastic substrate, such as, for example, polyimide, polyphenylene sulfide, polyamide imide, polyketone, polyphthalamide, polyetheretherketone (PEEK), polyethersulfone, polyetherimide, and polyaryletherketone. In other embodiments, the substrate 102, 402 can be a metal substrate, such as, for example, steel and aluminum. The substrate 102, 402 can have any suitable shape such as, for example, a roll and a belt. The thickness of the substrate 102, 402 in a belt configuration can be from about 50 μm to about 300 μm, and in some cases from about 50 μm to about 100 μm. The thickness of the substrate 102, 402 in a cylinder or a roll configuration can be from about 2 mm to about 20 mm, and in some cases from about 3 mm to about 10 mm.

In various embodiments, the fuser member 110, 410 can also include one or more optional adhesive layers (not shown); the optional adhesive layers (not shown) can be disposed between the substrate 402 and the compliant layer 404 and/or between the compliant layer 404 and the top-coat layer 406 and/or between the substrate 102 and the top-coat layer 106 to ensure that each layer 106, 404, 406 is bonded properly to each other and to meet performance target. Exemplary materials for the optional adhesive layer can include, but are not limited to epoxy resins and polysiloxanes.

Referring back to the printing apparatus 100, the printing apparatus 100 can be a xerographic printer, as shown in FIG. 1. In certain embodiments, the printing apparatus 100 can be an inkjet printer (not shown).

FIG. 5 schematically illustrates an exemplary fuser subsystem 501 in a belt configuration of a xerographic printer. The exemplary fuser subsystem 501 can include a fuser belt 515 and a rotatable pressure roll 512 that can be mounted forming a fusing nip 511. In various embodiments, the fuser belt 515 and the pressure roll 512 can include a top-coat layer 106, 406 a plurality of fluorinated nanoparticles 307 dispersed in a fluoropolymer 309 disposed over a substrate 102 as shown in FIG. 2 or over a compliant layer 404, as shown in FIG. 4, such that the top-coat layer 106, 406 can have a continual self-releasing surface 108. A media 520 carrying an unfused toner image can be fed through the fusing nip 511 for fusing.

The disclosed exemplary top-coat layer 106, 406 of the fuser member 110, 410, 515 including a plurality of fluorinated nanoparticles 307 dispersed in a fluoropolymer 309 possesses the low surface energy of the and chemical inertness, needed for oil-less fusing. Furthermore, the fluorinated nanoparticle 307 fillers in the top-coat layer 106, 406 can result in an increase in the top-coat modulus, and a decrease in lead or side edge wear since paper edges may slide upon contact with a low surface energy fusing surface desired for long life of the fuser members 110, 410, 515. Additionally, the top-coat layer 106, 406 can be formed using simple techniques, such as, for example, spray coating, dip coating, brush coating, roller coating, spin coating, casting, and flow coating.

In various embodiments, the pressure members 112, 512, as shown in FIGS. 1 and 5 can also have a cross'section as shown in FIGS. 2 and 4 of the exemplary fuser member 110, 410.

Figure 6:
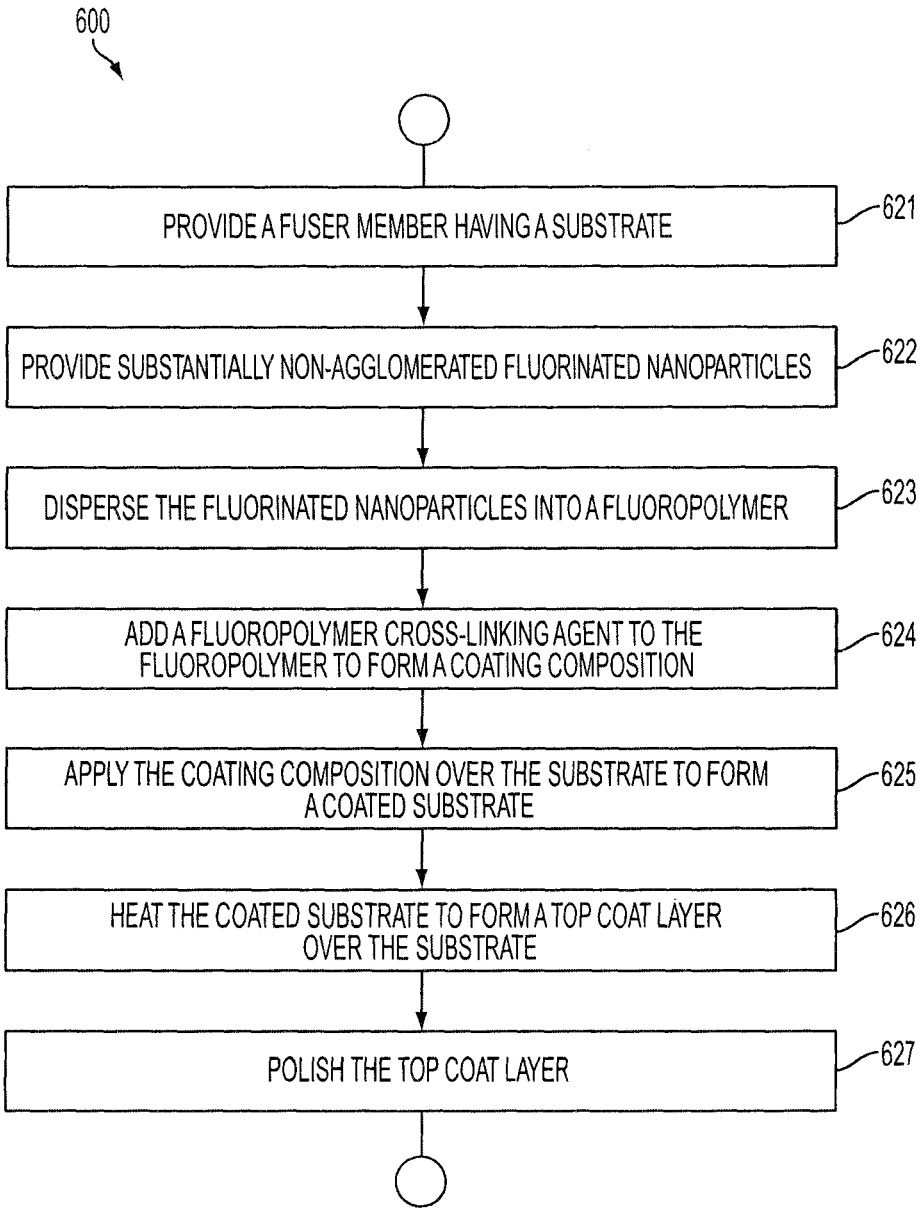
FIG. 6 shows an exemplary method of making a member of a fuser subsystem, according to various embodiments of the present teachings.
Figure 7:
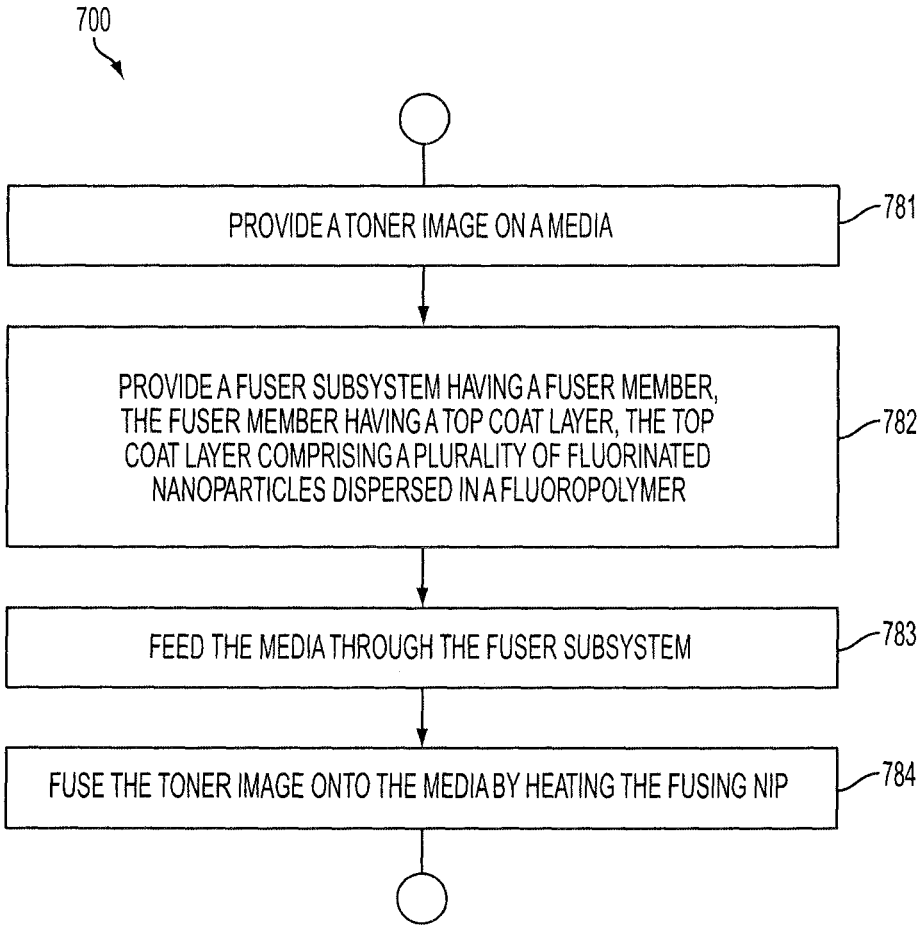
FIG. 7 shows an exemplary method of forming an image, according to various embodiments of the present teachings.

FIG. 6 schematically illustrates an exemplary method 600 of making a member of a fuser subsystem. The method 600 can include a step 621 of providing a fuser member, the fuser member including a substrate and a step 622 of forming fluorinated nanoparticles by co-hydrolysis of a mixture including a metal alkoxide and a fluoroalkylsilane. The method 600 can also include a step 623 of dispersing the fluorinated nanoparticles into a fluoropolymer to form a coating composition, such that the fluorinated nanoparticles are substantially uniformly dispersed throughout a bulk of the fluoropolymer. In various embodiments, the fluoropolymer can include a polymer having one or more monomer repeat units selected from the group consisting of vinylidene fluoride, hexafluoropropylene, tetrafluoroethylene, perfluoro(methyl vinyl ether)., perfluoro(ethyl vinyl ether), and perfluoro (propyl vinyl ether). Exemplary fluoropolymer can include, but is not limited to, polytetrafluoroethylene (PTFE); perfluoroalkoxy polymer resin (PFA); copolymer of tetrafluoroethylene (TFE) and hexafluoropropylene (HFP); copolymers of hexafluoropropylene (HFP) and vinylidene fluoride (VDF or VF2); terpolymers of tetrafluoroethylene (TFE), vinylidene fluoride (VDF), and hexafluoropropylene (HFP); and tetrapolymers of tetrafluoroethylene (TFE), vinylidene fluoride (VF2), and hexafluoropropylene (HFP). In some embodiments, the step 623 of dispersing the fluorinated nanoparticles into a fluoropolymer can include melt blending the fluorpolymer with the fluorinated nanoparticles, such that the fluorinated nanoparticles are substantially uniformly dispersed in the fluoropolymer. In other embodiments, the step 623 of dispersing the fluorinated nanoparticles into a fluoropolymer can include dispersing fluorinated nanoparticles in a first solvent, providing a fluoropolymer solution comprising a fluoropolymer in a second solvent, and adding the dispersed fluorinated nanoparticles to the fluoropolymer solution to form a coating composition, such that the fluorinated nanoparticles are substantially uniformly dispersed in the fluoropolymer. Any suitable solvent can be used for the first solvent and the second solvent, including, but not limited to water, an alcohol, a $C_5$-$C_{18}$ aliphatic hydrocarbon, a $C_6$-$C_{18}$ aromatic hydrocarbon, an ether, a ketone, an amide, and the mixtures thereof. The method 600 can further include a step 624 of adding a fluoropolymer cross-linking agent to the coating composition. Exemplary crosslinking agent can include, but is not limited to, a bis-phenol, a diamine, and an aminosilane.

The method 600 of making a member of a fuser subsystem can further include a step 625 of applying the coating composition over the substrate to form a coated substrate. Any suitable technique can be used for applying the dispersion to the one region of the substrate, such as, for example, spray coating, dip coating, brush coating, roller coating, spin coating, casting, and flow coating. In certain embodiments, the step 625 of applying the coating composition over the substrate to form a coated substrate can include forming a compliant layer over the substrate and applying the coating composition over the compliant layer to form a coated substrate. Any suitable material can be used to form the compliant layer, including, but not limited to, silicones, fluorosilicones, and a fluoroelastomers.

The method 600 can also include a step 626 of curing the coated substrate to form a top-coat layer over the substrate and a step 627 of polishing the top-coat layer so that a continual self-releasing surface is formed at a surface of the top-coat layer. In various embodiments, curing can be done in the range of about 200° C. to about 400° C. While not bound by any theory, it is also believed that the fluorinated crosslinking agent and/or the first and second solvent either evaporate or disintegrate during the curing process, leaving only the fluorinated nanoparticles and the fluoropolymer in the top-coat layer. Any suitable polishing method can be used, such as, for example mechanical polishing with a pad.

Examples are set forth herein below and are illustrative of different amounts and types of reactants and reaction conditions that can be utilized in practicing the disclosure. It will be apparent, however, that the invention can be practiced with other amounts and types of reactants and reaction conditions than those used in the examples, and the resulting devices various different properties and uses in accordance with the disclosure above and as pointed out hereinafter.

EXAMPLES

Example 1

Preparation of Fluorinated Nanoparticles

About 20.8 parts of tetraethylorthosilicate was added to about 5.1 parts of tridecafluoro(octyl)triethoxysilane in about 100 ml of ethanol. The solution was mixed with ammonium hydroxide/ethanol solution (about 24 ml of 28% $NH_3.H_2O$ in about 100 ml of ethanol), and stirred intensively at room temperature for about 12 hours. The resulting mixture was heated at about 110° C. for about one hour in air. The precipitated fluorinated silica particles were washed and filtered and had a particle size in the range of about 10 nm to about 100 nm, as measured by a particle analyzer (Nanotrac 252, Microtrac Inc., North Largo, Fla.).

Example 2

Dispersion of fluorinated Nanoparticles in a Fluoropolymer

A fluoropolymer composite "$A_{FC}$" was prepared as follows: about 5 grams of fluorinated nanoparticles and about 50 grams of Viton GF (available from E. I. du Pont de Nemours, Inc.) were mixed at about 170° C. using a twin screw extruder at a rotor speed of about 20 revolutions per minute (rpm) for about 20 minutes to form a polymer composite containing about 10 pph of fluorinated nanoparticles. Similar procedure was used to prepare two other fluoropolymer composites "$B_{FC}$" and "$C_{FC}$" with 20 pph and 30 pph of fluorinated nanoparticles respectively.

Example 3

Preparation of a Top-Coat Layer

Three coating compositions $A_{CC}$, $B_{CC}$, and $C_{CC}$ were prepared, each containing 17 weight percent fluoropolymer composites $A_{FC}$, $B_{FC}$, and $C_{FC}$ dissolved in methyl isobutylketone (MIBK) and combined with 5 pph (parts per hundred versus weight of VITON®-GF) AO700 crosslinker (aminoethyl aminopropyl trimethoxysilane crosslinker from Gelest) and 24 pph Methanol. The coating compositions $A_{CC}$, $B_{CC}$, and $C_{CC}$ were coated onto three aluminum substrates with a barcoater and the coatings were cured via stepwise heat treatment over about 24 hours at temperatures between 49° C. and 218° C.

TABLE 1

| Sample Number | Base Polymer | AO700 Loading/pph | F-NP Loading/pph |
|---|---|---|---|
| A | Viton | 5 | 10 |
| B | Viton | 5 | 20 |
| C | Viton | 5 | 30 |

Example 4

Measurement of Surface Free Energy of Samples from Example 3

Surface free energies of the samples A, B, and C were measured for gap-coated Viton/F-NP composite coatings as prepared, and after polishing (samples $A_P$, $B_P$, and $C_P$) using W-20 polishing paper. The polishing simulated a super finishing procedure used for iGen Fuser rolls prior to use. For comparison, a Viton/AO700 control sample D and a Viton/AO700 coating having a layer of fluorinated nanoparticles deposited over the surface (E) were also made. Surface free energy was measured for each sample by contact angle of drops of three liquids: water, formamide, and diiodomethane and is shown in Table 2. The surface free energies of the samples A, B, and C (gap-coated Viton/F-NP composite coatings as prepared) were equivalent to that of the control sample D. However, polishing lowers the surface free energies to towards the target of 18 mN/m (value for Teflon®) for 10 and 20 pph samples $A_P$ and $B_P$, and is lower than that for Teflon® for the 30 pph sample $C_P$. Furthermore, incorporation at 30 pph approaches the very low surface free energy value of about 12 mN/m observed for sample E, with a fluorinated nanoparticles overcoat on a Viton/AO700 surface.

TABLE 2

| Sample Number | Sample Description | SFE - 0.1 s | SFE - 1 s | SFE - 10 s |
|---|---|---|---|---|
| A | 10 pph F-NP | 25.01 | 24.59 | 24.68 |
| B | 20 pph F-NP | 23.22 | 23.24 | 23.17 |
| C | 30 pph F-NP | 23.52 | 23.31 | 23.33 |
| $A_P$ | 10 pph F-NP, polished | 19.74 | 19.73 | 19.99 |
| $B_P$ | 20 pph F-NP, polished | 18.98 | 19.65 | 19.56 |
| $C_P$ | 30 pph F-NP, polished | 14.68 | 14.84 | 13.88 |
| D | Viton/AO700 control | 23.43 | 23.47 | 23.28 |
| E | F-NP overcoat | 12.00 | 12.76 | 11.97 |

The results described above in Table 2 indicate that the incorporation of self-releasing nanoparticle fillers such as fluorinated nanoparticles can greatly reduce surface energy of fluoroelastomer coatings. Furthermore, the disclosed approach combines the low surface energy characteristics of Teflon® like materials while maintaining the fluoroelastomer properties of materials currently used in fuser rolls.

While the invention has been illustrated respect to one or more implementations, alterations and/or modifications can be made to the illustrated examples without departing from the spirit and scope of the appended claims. In addition, while a particular feature of the invention may have been disclosed with respect to only one of several implementations, such feature may be combined with one or more other features of the other implementations as may be desired and advantageous for any given or particular function. Furthermore, to the extent that the terms "including", "includes", "having", "has", "with", or variants thereof are used in either the detailed description and the claims, such terms are intended to be inclusive in a manner similar to the term "comprising." As used herein, the phrase "one or more of", for example, A, B, and C means any of the following: either A, B, or C alone; or combinations of two, such as A and B, B and C, and A and C; or combinations of three A, B and C.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A printing apparatus comprising:

a fuser member and a pressure member, the fuser member and pressure member positioned in a fuser subsystem to form a fusing nip, the fuser subsystem being configured to receive a media having an unfused image thereon so that the media is fed through the fusing nip such that the unfused image contacts a surface of the fuser member and is fused to the media, the fuser member comprising:

a substrate;

a polished top-coat layer disposed over the substrate; and a compliant layer comprising silicone disposed between the substrate and the top-coat layer, the compliant layer having a thickness of from about 10 μm to about 10 mm, the top-coat layer comprising:

a fluoropolymer crosslinked with an aminosilane, wherein the fluoropolymer comprises one or more monomeric repeat units selected from the group consisting of vinylidene fluoride, hexafluoropropylene, tetrafluoroethylene, perfluoro(methyl vinyl ether), perfluoro(propyl vinyl ether), and perfluoro (ethyl vinyl ether), wherein the fluoropolymer provides a fluoroelastomer coating and comprises at least the vinylidene fluoride and hexafluoropropylene monomeric repeat units, and wherein the aminosilane is aminoethyl aminopropyl trimethoxysilane; and a plurality of fluorinated silica nanoparticles substantially uniformly dispersed throughout the bulk of the fluoroelastomer coating to decrease a surface energy of the top-coat layer and to provide a continual self-releasing surface to the top-coat layer, wherein the top-coat layer is configured to maintain the self-releasing surface during fusing subsequent to a decrease in thickness of the top-coat layer, where the decrease in thickness results from wear during use, wherein the fluorinated silica nanoparticles are formed by co-hydrolysis and condensation of a mixture comprising a metal alkoxide and a fluoroalkylsilane, the metal alkoxide being tetraethylorthosilicate and the fluoroalkylsilane being tridecafluoro(octyl)triethoxysilane, the silica nanoparticles precipitating from the mixture and having an average diameter in the range of about 10 nm to about 500 nanometers, and wherein the polished top-coat layer has a surface free energy ranging from about 14 mN/m to about 20 mN/m, the surface free energy being lower than the surface free energy of the same top-coat layer if the top-coat layer was not polished, the printing apparatus further comprising an electrophotographic photoreceptor, a charging station for uniformly charging the electrophotographic photoreceptor, an imaging station for forming a latent image on the electrophotographic photoreceptor, a development subsystem for converting the latent image to a visible image on the electrophotographic photoreceptor and a transfer subsystem for transferring the visible image as an unfused image to the media, wherein the fuser subsystem is separate from the electrophotographic photoreceptor and is configured so as to receive media with the unfused image formed thereon.

2. The printing apparatus of claim 1, wherein the fluoropolymer comprises more than 60% of fluorine content by weight of the fluoropolymer.

3. The printing apparatus of claim 1, wherein the fluorinated silica nanoparticles further comprise a moiety chemically bound with the fluoropolymer.

4. The printing apparatus of claim 1, wherein the fluorinated silica nanoparticles are present in an amount ranging from about 0.5 to about 20 percent by weight of the top-coat layer composition.

5. The printing apparatus of claim 1, wherein the fuser member comprises a substrate made of a polymeric material or a metal in a form of a roll or a belt.

6. A printing apparatus comprising:

a fuser member and a pressure member, the fuser member and pressure member positioned in a fuser subsystem to form a fusing nip, the fuser subsystem being configured to receive a media having an unfused image thereon so that the media is fed through the fusing nip such that the unfused image contacts a surface of the fuser member and is fused to the media, the fuser member comprising:

a substrate; and a polished top-coat layer disposed over the substrate, the top-coat layer comprising:

a fluoropolymer crosslinked with a crosslinking agent selected from the group consisting of a bis-phenol, a diamine, and an aminosilane, wherein the fluoropolymer comprises one or more monomeric repeat units selected from the group consisting of vinylidene fluoride, hexafluoropropylene, tetrafluoroethylene, perfluoro(methyl vinyl ether), perfluoro(propyl vinyl ether), and perfluoro(ethyl vinyl ether), wherein the fluoropolymer provides a continuous fluoroelastomer coating and comprises at least the vinylidene fluoride and hexafluoropropylene monomeric repeat units; and a plurality of fluorinated silica nanoparticles substantially uniformly dispersed throughout the bulk of the fluoroelastomer coating to decrease a surface energy of the top-coat layer and to provide a continual self-releasing surface to the top-coat layer, wherein the top-coat layer is configured to maintain the self-releasing surface during fusing subsequent to a decrease in thickness of the top-coat layer, where the decrease in thickness results from wear during use, wherein the fluorinated silica nanoparticles are formed by co-hydrolysis and condensation of a mixture comprising a metal alkoxide and a fluoroalkylsilane, the metal alkoxide being tetraethylorthosilicate and the fluoroalkylsilane being selected from the group consisting of heptadecafluorodecyltrimethoxysilane, heptadecafluorodecyltriethoxysilane, and mixtures thereof, the fluorinated silica nanoparticles precipitating from the mixture and having an average diameter in the range of about 10 nm to about 500 nanometers, and the printing apparatus further comprising an electrophotographic photoreceptor, a charging station for uniformly charging the electrophotographic photoreceptor, an imaging station for forming a latent image on the electrophotographic photoreceptor, a development subsystem for converting the latent image to a visible image on the electrophotographic photoreceptor and a transfer subsystem for transferring the visible image as an unfused image to the media, wherein the fuser subsystem is separate from the electrophotographic photoreceptor and is configured so as to receive media with the unfused image formed thereon, wherein the polished top-coat layer has a surface free energy ranging from about 14 mN/m to about 20 mN/m, the surface free energy being lower than the surface free energy of the same top-coat layer if the top-coat layer was not polished.

7. The printing apparatus of claim 6, wherein the mixture further comprises at least one of an aminosilane compound, or a phenol-containing silane compound.

8. The printing apparatus of claim 7, wherein the aminosilane compound is selected from the group consisting of 4-aminobutyltriethoxysilane, N-(2-aminoethyl)-3-aminopropyltriethoxysilane, N-(2-aminoethyl)-3-aminopropylmethyldiethoxysilane, N-(2-aminoethyl)-3-aminopropyltrimethoxysilane, 3-aminopropyltrimethoxysilane, 3-aminopropyltriethoxysilane, 3-aminopropylmethyldimethoxysilane, 3-aminopropylmethyldiethoxysilane, and mixtures thereof.

9. The printing apparatus of claim 7, wherein the phenol-containing silane compound is selected from the group consisting of:

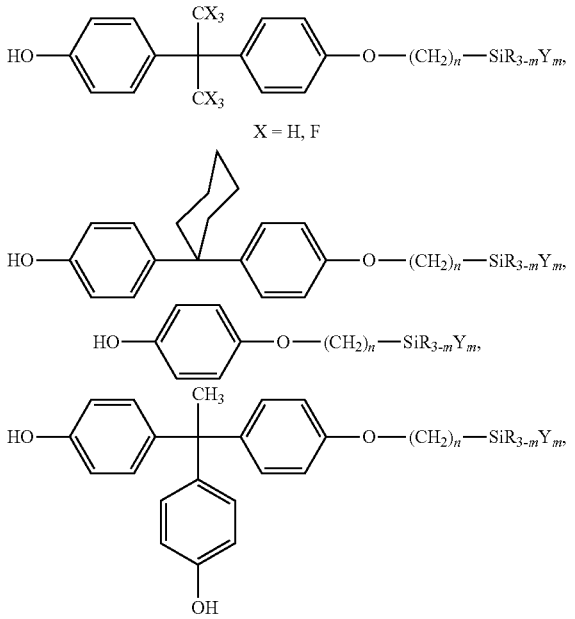

-continued

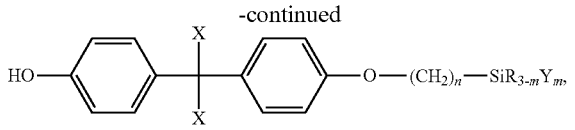

X = H, F and mixtures thereof, wherein R is a hydrocarbyl group comprising 1 to about 15 carbon atoms; Y is selected from the group consisting of hydroxyl, alkoxy, halide and carboxylate; n is an integer from 1 to 12; and m is an integer from 1 to 3.

10. A fuser subsystem comprising:

a fuser member and a pressure member, the fuser member and pressure member positioned in the fuser subsystem to form a fusing nip, the fuser subsystem being configured to receive a media having an unfused image thereon so that the media is fed through the fusing nip such that the unfused image contacts a surface of the fuser member and is fused to the media, the fuser member comprising:

a substrate; and a polished top-coat layer disposed over the substrate, the top-coat layer comprising:

a fluoropolymer crosslinked with a crosslinking agent selected from the group consisting of a bis-phenol, a diamine, and an aminosilane, wherein the fluoropolymer comprises one or more monomeric repeat units selected from the group consisting of vinylidene fluoride, hexafluoropropylene, tetrafluoroethylene, perfluoro(methyl vinyl ether), perfluoro(propyl vinyl ether), and perfluoro(ethyl vinyl ether), wherein the fluoropolymer provides a continuous fluoroelastomer coating and comprises at least the vinylidene fluoride and hexafluoropropylene monomeric repeat units; and a plurality of fluorinated silica nanoparticles substantially uniformly dispersed throughout the bulk of the fluoroelastomer coating to decrease a surface energy of the polished top-coat layer and to provide a continual self-releasing surface to the polished top-coat layer, wherein the top-coat layer is configured to maintain the self-releasing surface during fusing subsequent to a decrease in thickness of the top-coat layer, where the decrease in thickness results from wear during use, wherein the fluorinated silica nanoparticles are formed by co-hydrolysis and condensation of a mixture comprising a metal alkoxide and a fluoroalkylsilane, the metal alkoxide being tetraethylorthosilicate and the fluoroalkylsilane being tridecafluoro(octyl)triethoxysilane, the silica nanoparticles precipitating from the mixture and having an average diameter in the range of about 10 nm to about 500 nanometers, and wherein the polished top-coat layer has a surface free energy ranging from about 14 mN/m to about 20 mN/m, the surface free energy being lower than the surface free energy of the same top-coat layer if the top-coat layer was not polished.

11. The fuser subsystem of claim 10, wherein the fluorinated silica nanoparticles have an average diameter in the range of about 10 nm to about 500 nanometers.

12. The fuser subsystem of claim 10, wherein the aminosilane is aminoethyl aminopropyl trimethoxysilane.

13. The fuser subsystem of claim 10, wherein the fuser member further comprises a compliant layer disposed between the substrate and the top-coat layer.

14. The fuser subsystem of claim 13, wherein the compliant layer has a thickness of from about 10 μm to about 10 mm.

15. The fuser subsystem of claim 14, wherein the compliant layer comprises silicone.

16. A printing apparatus comprising the fuser subsystem of claim 10, the printing apparatus further comprising an electrophotographic photoreceptor, a charging station for uniformly charging the electrophotographic photoreceptor, an imaging station for forming a latent image on the electrophotographic photoreceptor, a development subsystem for converting the latent image to a visible image on the electrophotographic photoreceptor and a transfer subsystem for transferring the visible image as an unfused image to the media, wherein the fuser subsystem is separate from the electrophotographic photoreceptor and is configured so as to receive media with the unfused image formed thereon.

* * * * *